US005293662A

United States Patent [19]

Newman, Sr. et al.

[11] Patent Number: 5,293,662

[45] Date of Patent: Mar. 15, 1994

[54] CORNER PAINT PAD ASSEMBLY

[75] Inventors: Robert D. Newman, Sr.; Robert D. Newman, Jr., both of Greenwood, Mo.

[73] Assignee: Mr. Longarm, Inc., Greenwood, Mo.

[21] Appl. No.: 86,196

[22] Filed: Jul. 1, 1993

Related U.S. Application Data

[63] Continuation of Ser. No. 761,487, Sep. 18, 1991, abandoned.

[51] Int. Cl.[5] ..... B05C 17/00

[52] U.S. Cl. ..... 15/210.1; 15/145; 403/152

[58] Field of Search ..... 15/235.7, 210 R, 145, 15/244.1, 160, 144.2, 143.1; 403/299, 343, 152

[56] References Cited

U.S. PATENT DOCUMENTS

| | | | |
|---|---|---|---|
| 2,818,593 | 1/1958 | Klingler | 15/143.1 |
| 3,056,159 | 10/1962 | Hoveland | 15/235.7 |
| 3,224,025 | 12/1965 | Altrock | 15/144.2 |
| 3,339,220 | 9/1967 | Barry | 15/144.2 |
| 3,464,079 | 9/1969 | Palmeri | 15/210 R |
| 3,717,896 | 2/1973 | Chase et al. | 15/145 |
| 3,720,974 | 3/1973 | Rosendall | 403/152 |
| 3,728,755 | 4/1973 | Whalen | 15/210 R |
| 4,127,911 | 12/1978 | Cupp et al. | 15/145 |
| 4,594,816 | 6/1986 | Goldstein | 15/144.2 |
| 4,674,144 | 6/1987 | Palmeri | 15/210 R |
| 4,777,694 | 10/1988 | Young | 15/145 |
| 4,885,876 | 12/1989 | Henke | 15/144.2 |
| 4,893,369 | 1/1990 | Johnson | 15/244.1 |
| 4,896,394 | 1/1990 | Linn et al. | 15/145 |
| 5,010,618 | 4/1991 | Croft | 15/236.7 |

*Primary Examiner*—Harvey C. Hornsby
*Assistant Examiner*—Patrick F. Brinson
*Attorney, Agent, or Firm*—Hovey, Williams, Timmons & Collins

[57] ABSTRACT

Corner paint pad assembly (10) includes a painting pad (12) having a handle (14) which are interconnected by a rotatable joint including ears (28) and (30) on the rear surfaces (24) and (26) of the pad (12), each ear having a hole therein (28) and (30), there being an axle (62) received in said holes. The handle (14) includes a tubular stretch (48) adjacent the tip end (46), the tubular stretch (48) being internally threaded, there being a shank (50) and a base (44) of the hollow handle (14) which are tapered to receive the end of an extension pole or, in the alternative, a threaded insert (70) which may receive the threaded end of an extension pole.

1 Claim, 3 Drawing Sheets

10
12
14
16
16a
16b
16c
18
18a
18b
18c
20
22
24
26
28
30
32
34
36
38
40
42
43
44
46
48
50
52
54
60
62
82

CORNER PAINT PAD ASSEMBLY

This application is a continuation of Ser. No. 07/761,487 filed Sep. 18, 1991 now abandoned.

BACKGROUND OF THE INVENTION

1. Field of the Invention

This invention relates to a means for applying paint to walls and particularly to corners where two walls join to present a 90° angle, either in a vertical plane or a horizontal plane. The corner paint pad assembly includes a handle, which may be used as such or selectively mounted on various extension poles in order to reach otherwise inaccessible painting locations and a painting pad mounted on the handle and rotatable with respect thereto whereby the angular position of the pad may be varied to accommodate the position of the user of the paint pad assembly.

2. Description of the Prior Art

The use of paint rollers, paint pads of various configurations in the application of paint to walls and the like is known, as is the use of corner paint pads wherein the sections of the pad are disposed at a 90° angle with respect to one another in order that the paint pad may be utilized to paint the corner joints between two walls, whether such joints are in a vertical plane or a horizontal plane. Usually, one face of the corner paint pad has a suitable porous surface thereon such as a flocked foam material which will receive paint for application to the wall corner through use of the pad.

Handles for such corner painting pads are known but the same are usually rigidly affixed to the paint pad whereby it is necessary for the user to position himself in a number of varying positions as a given corner is painted in order to fully accommodate the painting face of the corner pad to the length of the corner wall joint.

What is needed is a corner paint pad assembly wherein the handle and the paint pad are initially separate pieces which may be readily joined together with the handle rotatably connected to the pad whereby the pad may at all times be kept in tight engagement with the surface to be painted with the user retaining his position and the handle swinging relative to the paint pad to accommodate movement of the pad along a corner joint which is being painted. Also needed is a handle which is capable of receiving the multitude of various extension poles which would normally be used in connection with a corner paint pad assembly in order to reach overhead wall corners for painting.

SUMMARY OF THE INVENTION

The corner paint pad assembly disclosed resolves a large number of the present problems in the utilization of such a painting pad assembly in that it provides a painting pad having an outer face coated with a porous material and an inner face having a pair of opposed ears whereby a handle may be rotatably connected to the pad through the ears to permit the pad and handle to be swung to various relative positions to one another. Accordingly, as the pad travels up a vertical wall corner joint, for instance, the handle and any extension pole which might be connected thereto, can swing relative to the pad from perhaps an initial 90° angle to a lesser angle as the pad progresses upwardly to paint the corner.

The pad of the corner paint pad assembly is made up of two sections attached together and disposed at a 90° angle with respect to one another, there being an ear on the inner face of each of the sections, each ear having a hole formed therein, the holes being in opposed relationship whereby an axle at the tip end of the handle may be received in each of the holes for permitting swinging movement of the two components; that is, the pad and the handle relative to one another.

The handle is provided with a base end, opposite the tip end which is connected to the pad, the base end being hollow to present an interior and an exterior surface. The exterior surface has gripping ribs strategically placed thereon so that a user who is gripping just the handle without utilization of an extension pole can firmly hold the assembly as the pad swings to various positions with respect to the handle as the corner paint pad is utilized to place paint in a wall corner joint.

The interior surface of the handle is provided at its upper end with threads to receive complementary threads on a usual type of extension pole such as, for instance, a broom or brush handle. In the event such an extension pole cannot be threaded with such threads on the interior surface of the hollow handle, the handle has a shank portion which is tapered from top to bottom in order that virtually any pole of an accommodating diameter may be wedge fitted into the interior of the tapered handle.

Lastly, a threaded insert is provided which is tubular and which may be received within the base end of the hollow handle and retained therein by means of holding tabs, the threaded insert comprising two identical halves hingedly connected to permit compression of the insert and placement thereof within the hollow handle base, the threads on such insert being of such a size and configuration as to permit it to receive threaded extension poles of differing diameters such as those in use internationally in connection with other painting accessories.

DESCRIPTION OF THE PREFERRED EMBODIMENT

Figures 1, 2, 6:
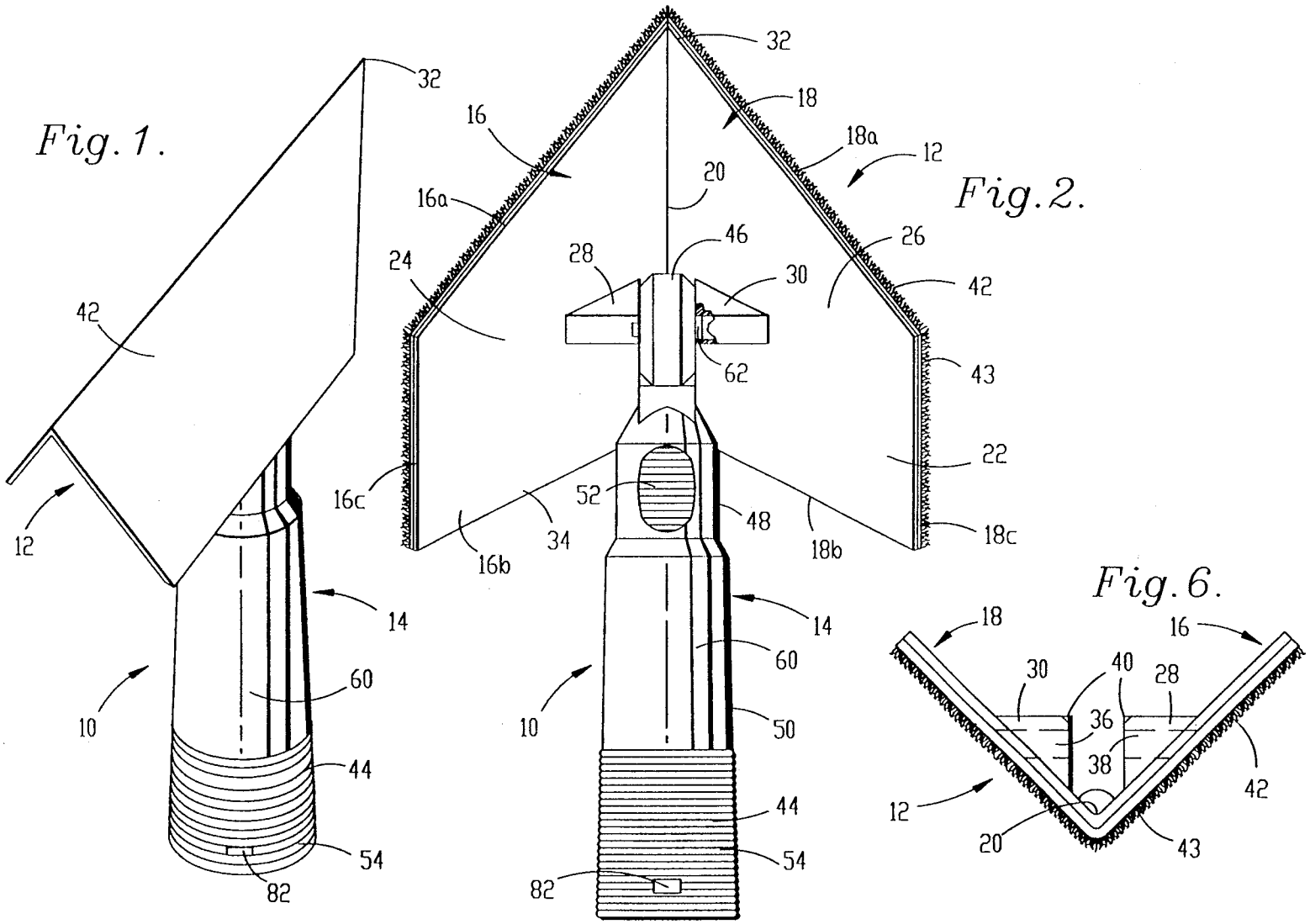
FIG. 1 is a perspective view of the corner paint pad assembly.
FIG. 2 is a rear elevational view thereof.
FIG. 6 is a top plan view of only the pad.

The corner paint pad assembly is broadly designated by the numeral 10 and includes, as its primary components, a painting pad 12 and a handle 14 which are interconnected at a rotatable joint so that they may be swung with respect to one another to thereby permit utilization of the assembly 10 by a user who may stay in one position as the pad is moved along a corner joint, for instance a vertical joint, either through utilization of the handle 14 or by employing an extension pole (not shown) which may be connected to the assembly 10 through the handle 14 in various manners which will be hereinafter described.

The pad 12 includes a pair of sections 16 and 18 connected together along a central joint 20, the sections 16 and 18 being disposed at a 90° angle with respect to one another whereby the joint 20 is of that configuration. As illustrated, the sections 16, 18 each present upper marginal edges 16*a*, 18*a*, opposed lower marginal edges 16*b*, 18*b* with these edges being interconnected by side marginal edges 16*c*, 18*c*. It will be appreciated that such disposition of the sections 16 and 18 permits the pad to be accommodated within the junction created when two walls meet, such junction normally presenting a 90° angle for painting. The inner face 22 of the pad 12 includes the normally rearmost surface 24 of section 16 and surface 26 of section 18 which are preferably planar walls.

Each of the rear surfaces 24 and 26 carries a generally triangular shaped ear 28 and 30 respectively, which ears are affixed to the surfaces 24 and 26 essentially at a midpoint between the point 32 of the pad and the base edge 34 of the pad.

The ears each have a centrally disposed hole formed therein, as best shown in FIG. 6 and identified as 36 in the case of ear 30 and 38 in the case of ear 28, said holes being in opposed, aligned relationship and extending entirely through their corresponding ears and into the rear surfaces 24 and 26 of the sections 16 and 18 respectively.

Figure 5:
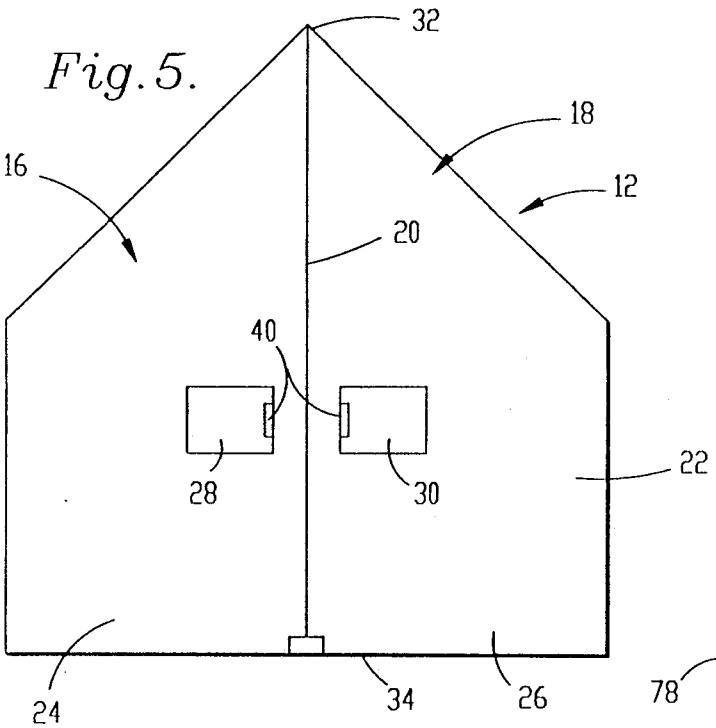
FIG. 5 is a rear elevational view of the pad without the handle.
Figure 7:
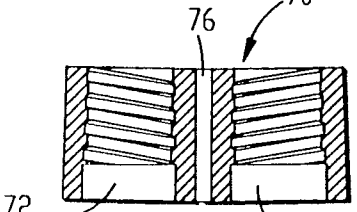
FIG. 7 is an elevational view of the threaded insert in an open condition.

Each of the ears 28 and 30 is provided, as best shown in FIGS. 5 and 6, with a ramp 40 which is beveled inwardly toward the entry of its corresponding hole whereby an axle carried at the tip end of the handle 14 may be readily and simultaneously inserted within the holes 36 and 38 when the pad is mounted on the handle.

To permit such insertion, the sections 16 and 18 which make up the pad 12 may be slightly flexed outwardly along the joint 20 so that as an axle moves along the ramps 40 the sections 16 and 18 will flex to permit the axle to pass along the ramps and the ends of the axle to be received within the holes 36 and 38.

The pad 12 is provided with an outer face 42 opposite to inner face 22 and of the reverse configuration, the outer face of the paint pad 12 being covered with a porous material such as, for instance, a flocked foam 44 which is conventionally used for its paint absorbing and paint applying characteristics.

The handle 14 is a molded plastic item and presents a base end 44 and a tip end 46, the ends being joined by a tubular stretch 48 and a shank 50. The tubular stretch 48 is provided with opposed gripping areas 52 so that a user may place his fingers thereon when utilizing the handle 14 to guide the pad 12 in painting a corner.

Figure 4:
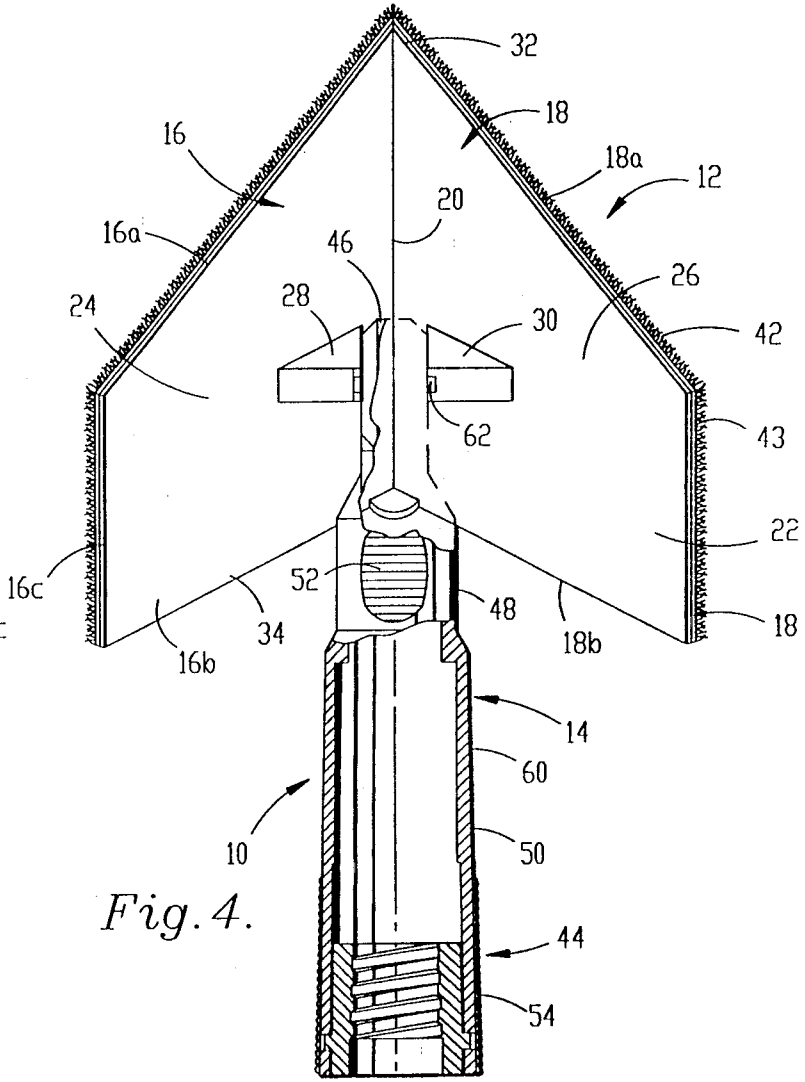
FIG. 4 is a rear elevational view similar to FIG. 3 with portions of the handle in section broken away and showing the threaded insert in place in the base of the handle.

The base end 44 of the handle is likewise provided with circumscribing exterior ribs 54 for gripping purposes. As best illustrated in FIGS. 3 and 4, the shank 50 and base 44 of the handle 14 are tapered from the junction of the shank 50 with the tubular stretch 48.

Figure 3:
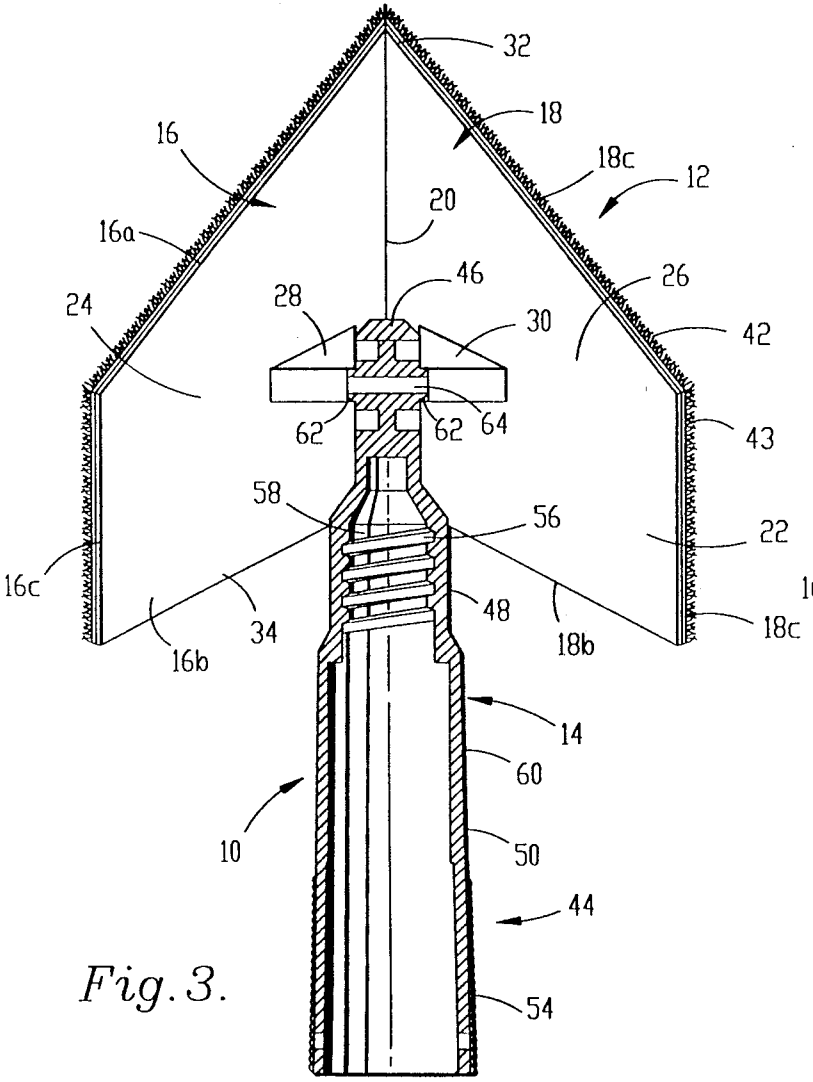
FIG. 3 is a view similar to FIG. 2 with the handle being shown in cross section.
Figure 10:
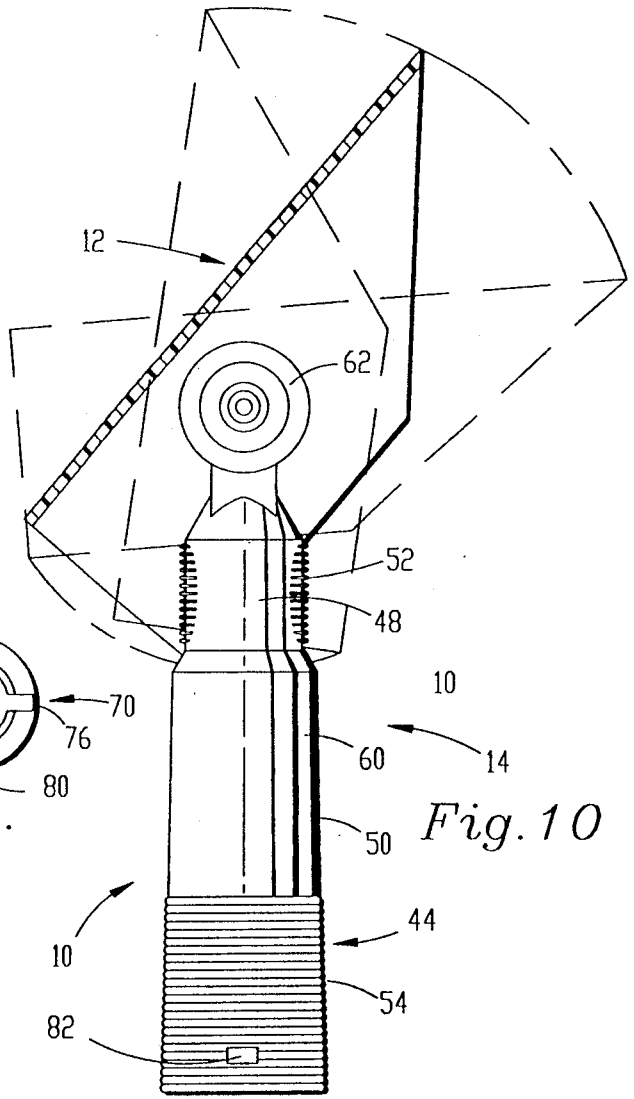
FIG. 10 is a side elevational view of the corner paint pad assembly and showing in dashed lines the various positions into which the pad may be swung with respect to the handle.

As shown in FIG. 3, the tubular stretch 48 is provided with interior threads 56. These are on the interior surface 58 of the handle 14 whereas the gripping areas 52 and 54 are in the form of ribs formed on the exterior surface 60 of the handle 14. The tip end 46 of the handle 14 which extends beyond the tubular stretch 48 is provided with an axle 62 which has opposed ends received within the aligned, opposed holes 36 and 38 of the ears 28 and 30. As best shown in FIG. 3, the axle 62 has a passage 64 extending therethrough and the tip end 46 of the handle is circular in overall configuration whereby to be readily accommodated between the ears 28 and 30 and permit swinging movement of the pad 12 and handle 14 with respect to one another through the ranges shown in FIG. 10, for instance.

When the axle 62 is to be inserted in the holes 36 and 38, the handle 14, which then is free from the pad 12, is gripped around the tapered portion and the extending ends 68 of the axle 62 aligned with the ramps 40 and the handle pushed toward the joint 20 whereby the ends 68 of the axle 62 move along their corresponding ramps 40 and are "popped into" their corresponding holes 36 and 38 in the ears 28 and 30. It will be appreciated that this creates a joint between the handle and the pad whereby the two components may be freely swung with respect to one another.

As noted previously, the interior threads 56 which are at the upper end of the hollow handle 14 may receive a conventional extension pole such as one which might be used as a push broom handle and which is normally provided with threads thereon. The end of such an extension handle would be inserted into the hollow handle 14 until the threads on the handle mate with the internal threads 56 through rotation of the extension pole with respect to such threads.

On the other hand, if it is desired to use a handle which has no threads thereon or which has a diameter whereby its threads cannot be accommodated by the tubular stretch 48 and the interior threads 56, then the end of such an extension pole may be wedged within the base end 44 and the tapered shank area 50 to create a tight fit between the handle and the end of the extension pole.

Figure 9:
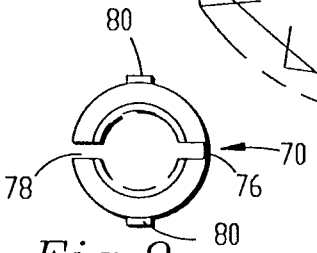
FIG. 9 is a top plan view of the threaded insert in a closed condition.
Figure 8:
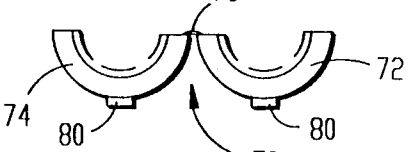
FIG. 8 is a top plan view of the threaded insert in an open condition.

Yet further, there is provided for placement within the base end 44 of the handle 14 a threaded insert broadly designated by the numeral 70 which has a pair of halves 72 and 74 swingably interconnected by a hinge 76 whereby the halves may be swung to an open condition as shown in FIG. 8, or to a closed condition as shown in FIG. 9, wherein a passage 78 is presented between the free ends of the halves to permit compression of the threaded insert and fitting thereof within the base end 44 of the handle 14 as illustrated in FIG. 4.

In order to ensure that the threaded insert 70 is securely received within the hollow base end 44, a pair of tabs 80 are provided in opposed relationship as shown in FIG. 9, the tabs being received within corresponding locking apertures 82 formed in the base end 44 of the handle 14, the interlocking relationship between the tabs 80 and the apertures 82 being clearly shown in FIG. 4 of the drawing.

The threaded insert is of such a size and configuration that it will readily accept threads provided on extension poles of a larger diameter than that which could be wedged within the hollow handle 14 and which poles are widely used internationally. Thus, a pole of a larger diameter, such as, for instance, an inch and an eighth, would not fit within the tapered hollow interior of the handle 14 but yet threads formed on the tip end thereof could be screwed into the insert 70, once the insert has been secured within the hollow base end of handle 14, whereby to create a tight threaded interconnection between the extension pole and the paint pad assembly 10. As is apparent from the drawings, the threads 72 and 74 of the insert 70 are on the interior surface thereof whereas the opposed tabs 80 are on the exterior surface and the insert may be compressed by utilization of passage 78 to push the same into the hollow base end 44 of the handle 14.

Thus, there is provided a corner paint pad assembly 10 which may be utilized through its conventionally provided handle 14 or by means of virtually all known extension poles which may be coupled with the handle 14 in the various manners described above, either directly or through the utilization of threaded insert 70. In use, the handle 14 and paint pad 12 are free to rotate with respect to one another whereby a user may, for instance, stand on the floor of a room and paint a corner by moving the pad from the floor towards the ceiling, the handle swinging with respect to the pad as it is moved upwardly and downwardly whereby the user is permitted to retain his position and his grip on the handle 14 or the extension pole (not shown) which has been coupled therewith. This greatly facilitates the use of the corner paint pad assembly.

We claim:

1. A corner paint pad assembly consisting essentially of:

a painting pad including a pair of interconnected wall sections disposed at a 90° angle with respect to one another to present a V-shaped body having an elongated apex at the joinder of said wall sections, said sections being relatively flexible and each having an inner and an outer face and presenting upper and lower marginal edges interconnected by a side marginal edge remote from said elongated apex, said lower marginal edges lying in a first plane substantially normal to said elongated apex, said upper marginal edges lying in a second plane which is obliquely oriented relative to said first plane with said side marginal edges having a length less than the length of said elongated apex, the ends of said upper marginal edges remote from said side marginal edges intersecting to define a pointed uppermost end for said body, said outer faces of said sections being coated with a porous material to receive paint, each of said inner faces having an inwardly projecting ear presenting an inboard face and an intersecting outer face, there being an opening in each of said ears extending inwardly from each corresponding inboard face and structure defining a beveled ramp in each ear inclined from each corresponding opening outwardly to the outer face of the ear;

an elongated handle oriented with the longitudinal axis thereof substantially within a third plane bisecting said body and passing through said elongated apex, said handle having a first end for releasable connection with said painting pad, and a second, hollow, threaded end remote from said first end for attachment of a handle extension; and a pair of oppositely outwardly extending axle members on said first connection end of said handle and releasably received within said ear openings for swinging movement of the handle through an arc of about 180° with respect to said body, with the longitudinal axis of the handle substantially within said third plane, said swinging movement being about a pivot axis substantially perpendicular to said third plane, said axle members within said ear openings preventing swinging movement of the handle substantially outside of said third plane about axes other than said pivot axis, said axle members and ears cooperatively supporting said first connection end of said handle in spaced relationship to the inner faces of said wall sections and said apex for permitting said swinging movement of said handle through said arc in an unobstructed manner free of engagement between said first connection end and said inner faces and apex, said ramps, and the relative flexibility of said interconnected wall sections, facilitating insertion and removal of said axle members into and out of said ear openings whereby said handle may be readily attached and detached from said pad.

* * * * *